US007319402B1

(12) United States Patent
Sudderth

(10) Patent No.: US 7,319,402 B1
(45) Date of Patent: Jan. 15, 2008

(54) COMBINED DOORBELL AND SMOKE DETECTION DEVICE

(76) Inventor: Randy D. Sudderth, 2704 NW. 16th St., Oklahoma City, OK (US) 73107

( * ) Notice: Subject to any disclaimer, the term of this patent is extended or adjusted under 35 U.S.C. 154(b) by 126 days.

(21) Appl. No.: 11/339,115

(22) Filed: Jan. 26, 2006

(51) Int. Cl.
*G08B 17/10* (2006.01)

(52) U.S. Cl. ..... 340/628; 340/506; 340/511; 340/521; 340/524; 340/538; 340/332; 340/815.46

(58) Field of Classification Search ..... 340/628, 340/506, 511, 521, 524, 538, 332, 815.46
See application file for complete search history.

(56) References Cited

U.S. PATENT DOCUMENTS 1,011,175 A 12/1911 Egan
3,056,122 A 9/1962 Moore
3,439,357 A 4/1969 De Gibaja
4,365,238 A * 12/1982 Kollin ..... 340/521
5,365,214 A 11/1994 Angott et al.
D501,652 S 2/2005 Pierson et al.
2003/0179096 A1 9/2003 Hanan
2004/0145467 A1* 7/2004 Roby et al. ..... 340/531
2006/0265195 A1* 11/2006 Woodard et al. ..... 702/188

* cited by examiner

*Primary Examiner*—Tai Nguyen

(57) ABSTRACT

A combined doorbell and smoke detection device includes a housing that has monolithically formed sides. One side includes openings formed adjacent to the housing top corners for receiving fasteners therethrough. Nested within the housing are a door bell chime, a first control unit, a carbon monoxide smoke detector, and an ionization smoke detector. A second control unit is coupled to the carbon monoxide and ionization smoke detectors, and includes an amplifier. A power interrupt diverting switch is disposed within the housing and is mated to an external power source. An internal power supply source is nested within the housing and is coupled to the power interrupt diverting switch. A transformer is coupled to the power interrupt diverting switch, and the first and second control units for converting a first voltage level to a second voltage level transmitted to the first and second control units respectively.

9 Claims, 5 Drawing Sheets

COMBINED DOORBELL AND SMOKE DETECTION DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to combined doorbell and smoke detector devices and, more particularly, to a combined doorbell and smoke detector device for alerting a homeowner when a guest has arrived and further when a dangerous level of smoke is present within a building structure.

2. Prior Art

It is a well known fact that most home owners are constantly striving to improve the aesthetic appeal of their homes, while also trying to make the residence as safe as possible. An important advance in the realm of home safety has been the introduction of smoke detectors. Such devices are usually positioned at strategic locations along the ceiling of a residence with a smoke sensor that is constantly exposed to the air. When such a sensor detects a threshold level of smoke particles in the air a loud alarm is activated for alerting persons in or around the house that such a threshold level of smoke has been breached.

Although a homeowner may know that such smoke detectors are invaluable to maintaining a safe residence, the placement of the sensor housings along the ceiling may appear unaesthetic to some individuals. This is especially true of instances where the color of the sensor housing does not closely or exactly match the color of the ceiling. Another device that is found in every home is the doorbell chime. Usually more than one chime is positioned throughout the home in strategic locations, as is the case with smoke detectors. The doorbell chime housing can either be placed along a wall or along the ceiling of a room, just like a smoke sensor housing. When a doorbell chime and smoke detector housing are located in the same room, two points of visual distraction are created that may draw away from other design features of the room. It is thus obviously beneficial to find a way to reduce the aesthetic interference created by multiple doorbell chime and smoke detector housings.

Accordingly, a need remains for a combined doorbell and smoke detector device in order to overcome the above-noted shortcomings. The present invention satisfies such a need by providing a combined doorbell and smoke detector that is easy to install, small and aesthetically appealing, and maintains the safety standards required of present day building codes. Such a device provides a loud, audible alarm in the event of a fire being detected in its immediate vicinity. The doorbell functions as a traditional doorbell device would. By combining both devices in a common housing a considerable amount of time is saved during installation procedures. The device also provides a neater and more attractive look in any room or hallway of a house.

BRIEF SUMMARY OF THE INVENTION

In view of the foregoing background, it is therefore an object of the present invention to provide a combined doorbell and smoke detector device. These and other objects, features, and advantages of the invention are provided by a combined doorbell and smoke detection device for alerting a homeowner when a guest has arrived and further when a dangerous level of smoke is present within a building structure.

The combined doorbell and smoke detection device includes a housing that has a plurality of linear and monolithically formed sides. One of the sides includes a plurality of openings formed adjacent to top corners of the housing. The one side is directly engaged against a support surface wherein a plurality of fasteners are passed through the openings and into the support surface such that the housing is effectively statically maintained at an elevated position during operating conditions.

A door bell chime and a first control unit that is electrically coupled directly to the door bell chime are nested within the housing. A carbon monoxide smoke detector is also nested within the housing and is disposed adjacent to the door bell chime. An ionization smoke detector is nested within the housing as well and is seated adjacent to the carbon monoxide smoke detector.

A second control unit is electrically coupled to the carbon monoxide and ionization smoke detectors respectively such that each of the carbon monoxide and ionization smoke detectors are conveniently and advantageously independently and simultaneously operable with each other and the door bell chime respectively. Such a second control unit generates and transmits an output signal to the carbon monoxide and ionization smoke detectors based upon a predetermined user input signal.

The second control unit further includes an amplifier for advantageously and effectively increasing an intensity of the output signal during operating conditions. Such a second control unit is further directly and independently coupled to the ionization and carbon monoxide smoke detectors respectively. The second control unit preferably includes an analog-to-digital converter for receiving the input signal in an analog format and transmitting the output signal to a digital format. A processor is electrically coupled to the analog-to-digital converter.

A memory is electrically coupled to the processor and includes software instructions that cause the second control unit to independently toggle the carbon monoxide and ionization smoke detectors between active and inactive modes. Such software instructions perform the steps of determining whether one of the ionization and carbon monoxide smoke detectors has detected one of a maximum smoke and carbon monoxide level in the ambient atmosphere, determining a duration of time in which the one detector has emitted a unique distress signal for more than a predetermined threshold time frame, and deactivating another one of the ionization and carbon monoxide smoke detectors until the distress signal is discontinued so that the operator can audibly identify which of the ionization and carbon monoxide smoke detectors has been triggered.

A power interrupt diverting switch is disposed within the housing and is electrically mated to an external power supply source. Such a power interrupt diverting switch channels power from the internal power supply source to the first and second control units when the external power supply source is inactive. The power interrupt diverting switch may be directly coupled to the first and second controllers as well as the transformer respectively. An internal power supply source is nested within the housing and is directly coupled to the power interrupt diverting switch. A transformer is electrically and directly coupled to the power interrupt diverting switch as well as the first and second control units for selectively converting a first voltage level received from the external power supply source to a second voltage level transmitted to the first and second control units respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
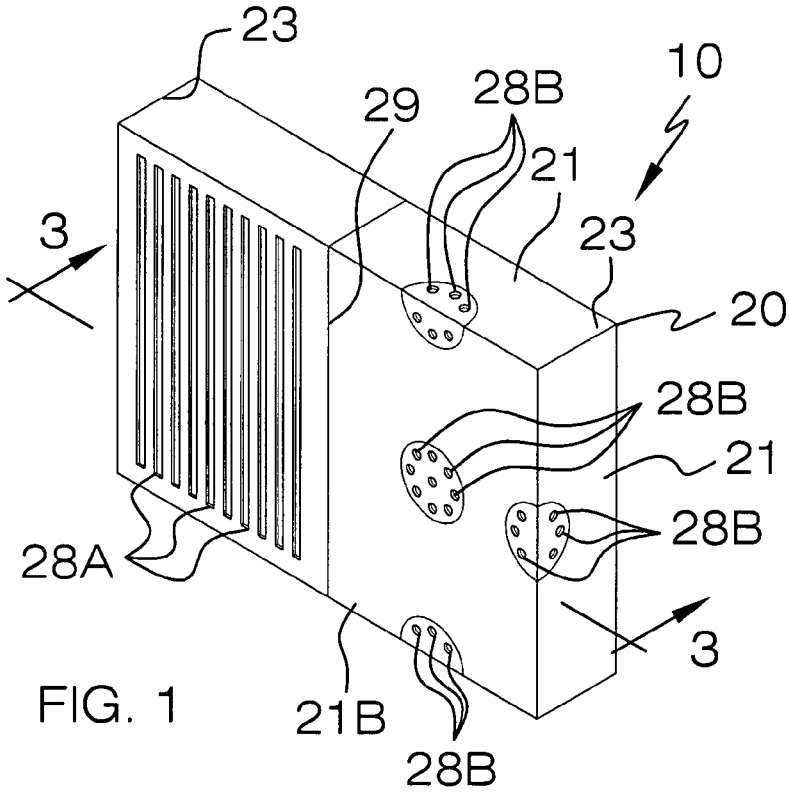
FIG. 1 is a top perspective view showing a combined doorbell and smoke detector device, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-5 by the reference numeral 10 and is intended to provide a combined doorbell and smoke detector device. It should be understood that the device 10 may be used to alert the occupants of many different types of buildings of the presence of harmful smoke or of the arrival of a person and should not be limited in use to only private residencies.

Referring to FIGS. 1, 2, 3 and 4, the device 10 includes a housing 20 that has a plurality of linear and monolithically formed sides 21. Of course, the housing 20 may be produced in a variety of alternate shapes, sizes and colors depending on the user's needs, as is obvious to a person of ordinary skill in the art. One of the sides 21A includes a plurality of openings 22 formed adjacent to top corners 23 of the housing 20. The one side 21A is directly engaged against a support surface (not shown) wherein a plurality of fasteners 11 are passed through the openings 22 and into the support surface, which is important such that the housing 20 is effectively statically maintained at an elevated position during operating conditions. Of course, the housing 20 may advantageously be engaged against a variety of alternately oriented support surfaces such as a vertical wall surface, an angled wall surface, or a horizontal ceiling to name a few, as is obvious to a person of ordinary skill in the art. This is an important feature for allowing the user to position the device 10 in the most concealed position possible for maintaining the aesthetic appeal of a room.

Figure 2:
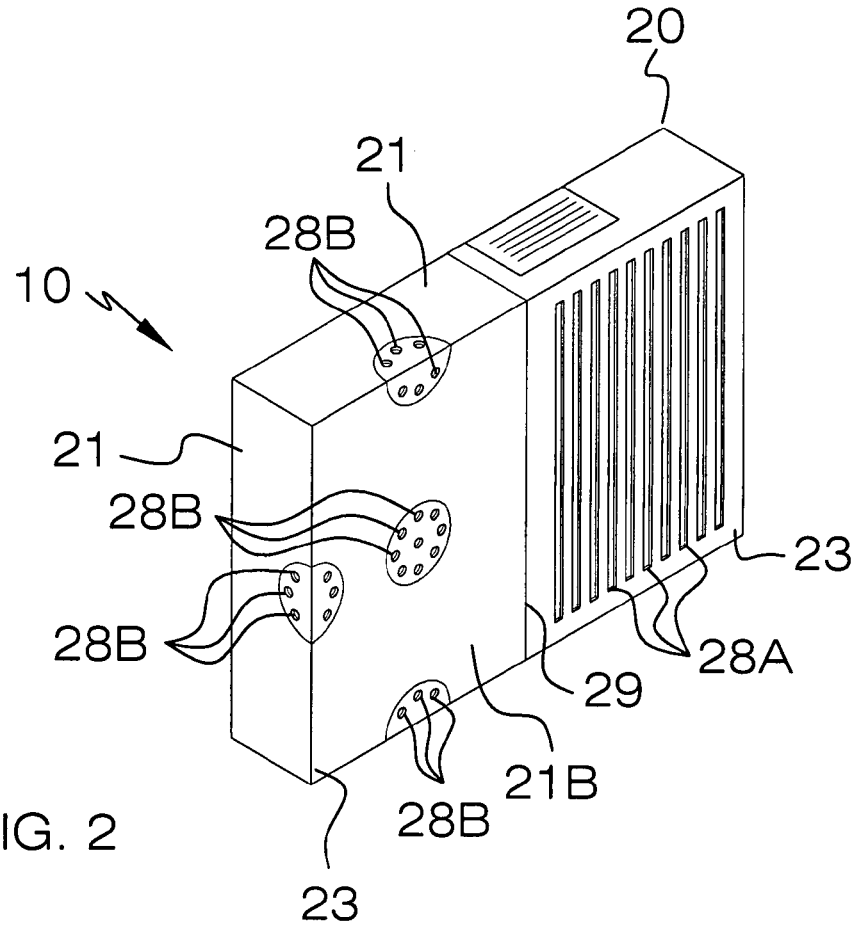
FIG. 2 is a bottom perspective view of the device shown in FIG. 1.
Figure 3:
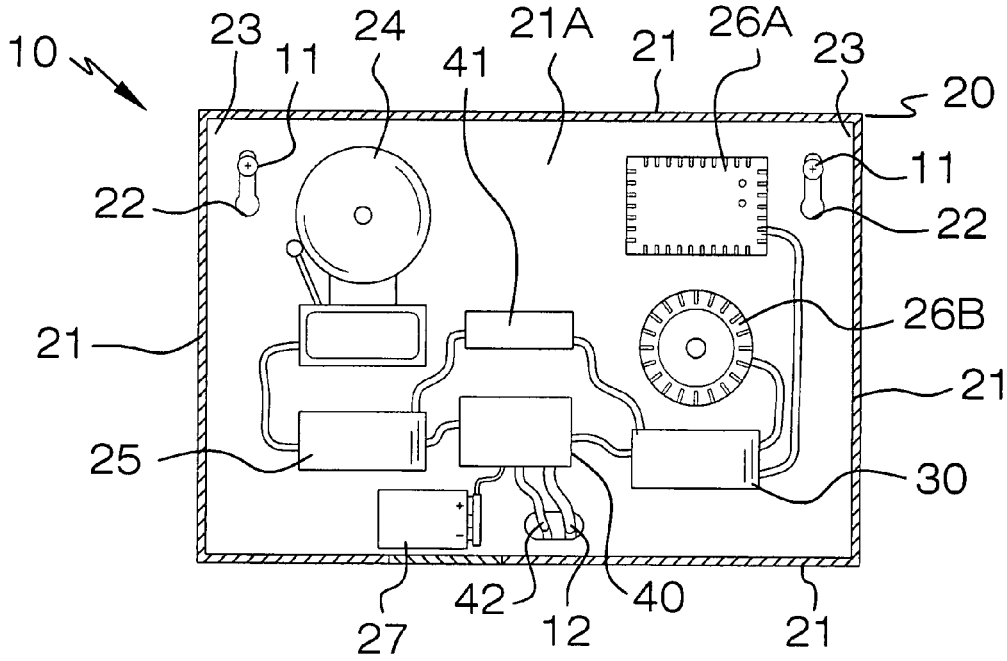
FIG. 3 is a cross-sectional view of the device shown in FIG. 1, taken along line 3-3.

Referring to FIGS. 2 and 3, a door bell chime 24 and a first control unit 25 that is electrically coupled directly, without the use of intervening elements, to the door bell chime 24 are nested within the housing 20. Of course, the door bell chime 24 may be produced to ring a variety of alternate tones depending on a user's preference, as is obvious to a person of ordinary skill in the art. A door bell button 42 is electrically coupled to the door bell chime 24, and is positioned to an exterior of the housing 20 at a suitable location where visitors can depress the button 43 for activating the door bell chime 24, which is important and convenient such that an occupant of the residence is notified of the visitor's arrival.

A carbon monoxide smoke detector 26A is also nested within the housing 20 and is disposed adjacent to the door bell chime 24. An ionization smoke detector 26B is nested within the housing 20 as well and is seated adjacent to the carbon monoxide smoke detector 26B. An internal power supply source 27 is nested within the housing and is directly coupled, without the use of intervening elements, to the power interrupt diverting switch 40 (described herein below). Nesting the door bell chime 24, carbon monoxide smoke detector 26A and ionization smoke detector 26B within the same housing 20 is a vital feature for limiting the number of housings 20 that must be placed along various support surfaces in a room, which in turn reduces the chance that such housings 20 will become an eyesore to the homeowner.

Another one of the sides 21B has a plurality of vertically oriented slots 28A and a plurality of apertures 28B formed on either side of a bifurcating line 29, respectively. Such slots 28A are crucial for allowing an audible sound created by the door bell chime 24 to exit the housing 20 and the apertures 28B are vital for allowing ambient air to enter the housing in order to be detected by the detectors 26 (described herein below).

Figure 4:
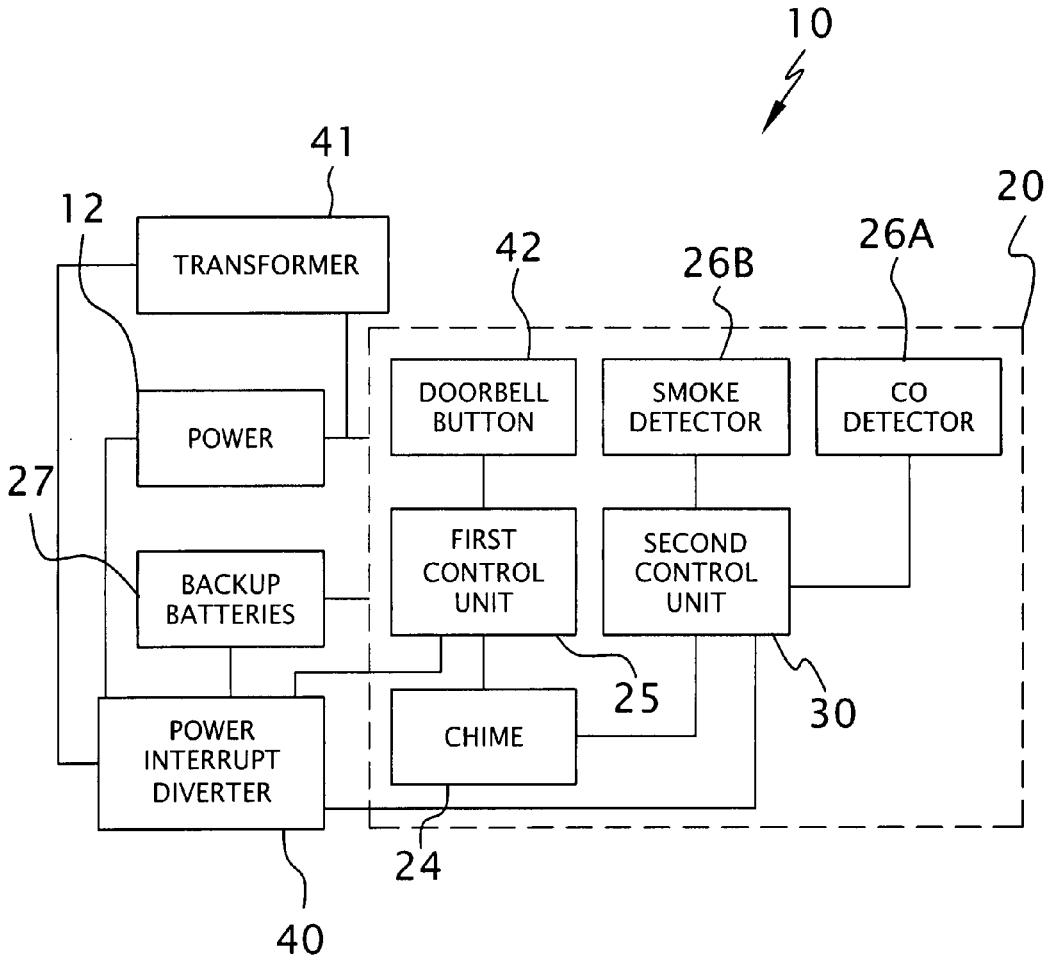
FIG. 4 is a schematic block diagram of the device shown in FIG. 3.
Figure 5:
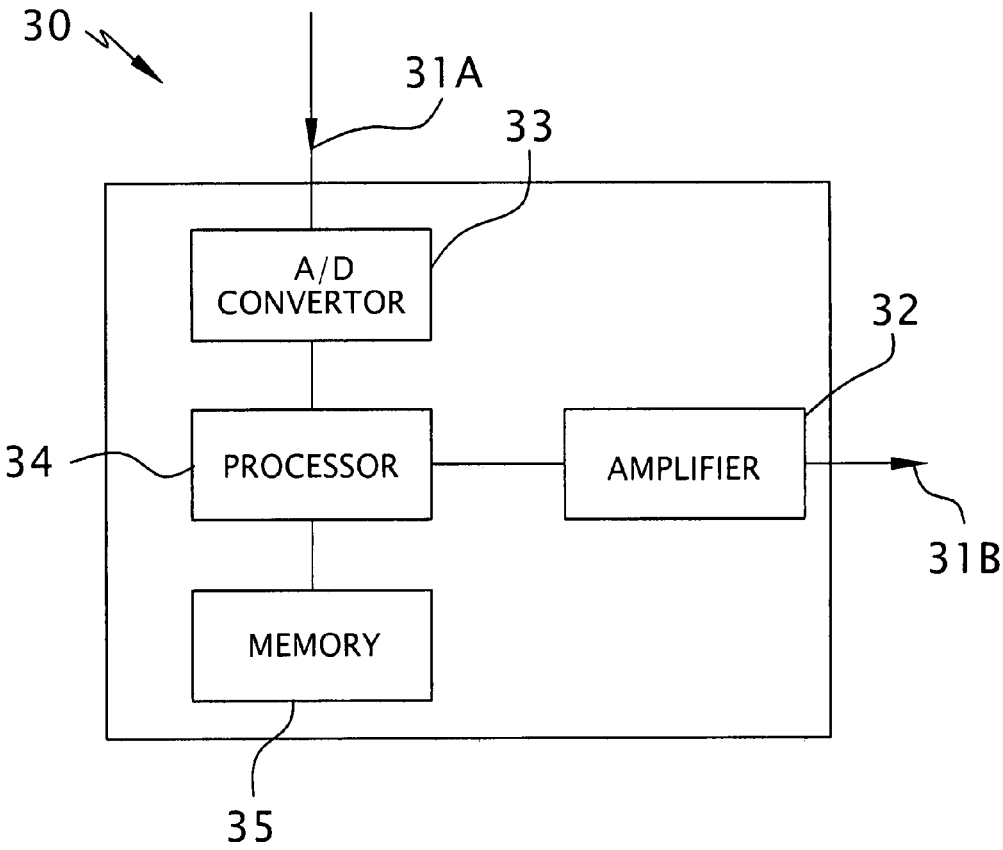
FIG. 5 is a schematic block diagram of the first control unit shown in FIGS. 3 and 4.

Referring to FIGS. 3, 4 and 5, a second control unit 30 is electrically coupled to the carbon monoxide 26A and ionization smoke 26B detectors respectively, which is essential such that each of the carbon monoxide 26A and ionization 26B smoke detectors are conveniently and advantageously independently and simultaneously operable with each other and the door bell chime 24 respectively. Such a second control unit 30 generates and transmits an output signal 31B to the carbon monoxide 26A and ionization 26B smoke detectors based upon a predetermined user input signal 31A.

The second control unit 30 includes an amplifier 32 that is crucial for advantageously and effectively increasing an intensity of the output signal 31B during operating conditions. Such a second control unit 30 is further directly and independently coupled, without the use of intervening elements, to the ionization 26B and carbon monoxide 26A smoke detectors respectively, as is best shown in FIGS. 3 and 4. The second control unit 30 further includes an analog-to-digital converter 33 that is vital for receiving the input signal 31A in an analog format and transmitting the output signal 31B to a digital format. A processor 34 is electrically coupled to the analog-to-digital converter 33.

Referring to FIG. 5, a memory 35 is electrically coupled to the processor 35 and includes software instructions that are critical for causing the second control unit 30 to independently toggle the carbon monoxide 26A and ionization 26B smoke detectors between active and inactive modes. Such software instructions perform the steps of determining whether one of the ionization 26B and carbon monoxide 26A smoke detectors has detected one of a maximum smoke and carbon monoxide level in the ambient atmosphere, determining a duration of time in which the one detector 26 has emitted a unique distress signal for more than a predetermined threshold time frame, and deactivating another one of the ionization 26B and carbon monoxide 26A smoke detectors until the distress signal is discontinued so that the operator can advantageously and effectively audibly identify which of the ionization 26B and carbon monoxide 26A smoke detectors has been triggered.

Referring to FIGS. 3 and 4, a power interrupt diverting switch 40 is disposed within the housing 20 and is electrically mated to an external power supply source 12. Such a power interrupt diverting switch 40 is essential and advantageous for channeling power from the internal power supply source 27 to the first 25 and second 30 control units when the external power supply source 12 is inactive, thus ensuring that, even in the event of an emergency, the device 10 will remain operational at all times.

A transformer 41 is electrically and directly coupled, without the use of intervening elements, to the power interrupt diverting switch 40 as well as the first 25 and second 30 control units, which is important for selectively converting a first voltage level received from the external power supply source 12 to a second voltage level transmitted to the first 25 and second 30 control units respectively. The power interrupt diverting switch 40 is directly coupled, without the use of intervening elements, to the first 25 and second 30 control units as well as the transformer 41 respectively.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined doorbell and smoke detection device for alerting a homeowner when a guest has arrived and further when a dangerous level of smoke is present within a building structure, said combined doorbell and smoke detection device comprising:

a housing having a plurality of linear and monolithically formed sides, one of said sides including a plurality of openings formed adjacent to top corners of said housing, said one side being directly engaged against a support surface wherein a plurality of fasteners are passed through said openings and into said support surface such that said housing is statically maintained at an elevated position during operating conditions;

a door bell chime nested within said housing;

a first control unit nested within said housing and being electrically coupled directly to said door bell chime;

a carbon monoxide smoke detector nested within said housing and disposed adjacent to said door bell chime;

an ionization smoke detector nested within said housing and seated adjacent to said carbon monoxide smoke detector;

a second control unit electrically coupled to said carbon monoxide and ionization smoke detectors respectively such that each of said carbon monoxide and ionization smoke detectors are independently and simultaneously operable with each other and said door bell chime respectively, said second control unit generating and transmitting an output signal to said carbon monoxide and ionization smoke detectors based upon a predetermined user input signal;

a power interrupt diverting switch disposed within said housing and electrically mated to an external power supply source;

an internal power supply source nested within said housing and directly coupled to said power interrupt diverting switch; and a transformer electrically and directly coupled to said power interrupt diverting switch as well as said first and second control units for selectively converting a first voltage level received from the external power supply source to a second voltage level transmitted to said first and second control units respectively;

wherein said power interrupt diverting switch channels power from said internal power supply source to said first and second control units when the external power supply source is inactive.

2. The device of claim 1, wherein said second control unit comprises:

an analog-to-digital converter for receiving said input signal in an analog format and transmitting said output signal to a digital format;

a processor electrically coupled to said analog-to-digital converter;

a memory electrically coupled to said processor and including software instructions that cause said second control unit to independently toggle said carbon monoxide and ionization smoke detectors between active and inactive modes, said software instructions performing the steps of a. determining whether one of said ionization and carbon monoxide smoke detectors has detected one of a maximum smoke and carbon monoxide level in the ambient atmosphere;

b. determining a duration of time in which said one detector has emitted a unique distress signal for more than a predetermined threshold time frame;

c. deactivating another one of said ionization and carbon monoxide smoke detectors until said distress signal is discontinued so that the operator can audibly identify which of said ionization and carbon monoxide smoke detectors has been triggered.

3. The device of claim 1, wherein said power interrupt diverting switch is directly coupled to said first and second controllers as well as said transformer respectively.

4. A combined doorbell and smoke detection device for alerting a homeowner when a guest has arrived and further when a dangerous level of smoke is present within a building structure, said combined doorbell and smoke detection device comprising:

a housing having a plurality of linear and monolithically formed sides, one of said sides including a plurality of openings formed adjacent to top corners of said housing, said one side being directly engaged against a support surface wherein a plurality of fasteners are passed through said openings and into said support surface such that said housing is statically maintained at an elevated position during operating conditions;

a door bell chime nested within said housing;

a first control unit nested within said housing and being electrically coupled directly to said door bell chime;

a carbon monoxide smoke detector nested within said housing and disposed adjacent to said door bell chime;

an ionization smoke detector nested within said housing and seated adjacent to said carbon monoxide smoke detector;

a second control unit electrically coupled to said carbon monoxide and ionization smoke detectors respectively such that each of said carbon monoxide and ionization smoke detectors are independently and simultaneously operable with each other and said door bell chime respectively, said second control unit generating and transmitting an output signal to said carbon monoxide and ionization smoke detectors based upon a predetermined user input signal, wherein said second control unit further comprises an amplifier for increasing an intensity of said output signal during operating conditions;

a power interrupt diverting switch disposed within said housing and electrically mated to an external power supply source;

an internal power supply source nested within said housing and directly coupled to said power interrupt diverting switch; and a transformer electrically and directly coupled to said power interrupt diverting switch as well as said first and second control units for selectively converting a first voltage level received from the external power supply source to a second voltage level transmitted to said first and second control units respectively;

wherein said power interrupt diverting switch channels power from said internal power supply source to said first and second control units when the external power supply source is inactive.

5. The device of claim 4, wherein said second control unit comprises:

an analog-to-digital converter for receiving said input signal in an analog format and transmitting said output signal to a digital format;

a processor electrically coupled to said analog-to-digital converter;

a memory electrically coupled to said processor and including software instructions that cause said second control unit to independently toggle said carbon monoxide and ionization smoke detectors between active and inactive modes, said software instructions performing the steps of a. determining whether one of said ionization and carbon monoxide smoke detectors has detected one of a maximum smoke and carbon monoxide level in the ambient atmosphere;

b. determining a duration of time in which said one detector has emitted a unique distress signal for more than a predetermined threshold time frame;

c. deactivating another one of said ionization and carbon monoxide smoke detectors until said distress signal is discontinued so that the operator can audibly identify which of said ionization and carbon monoxide smoke detectors has been triggered.

6. The device of claim 4, wherein said power interrupt diverting switch is directly coupled to said first and second controllers as well as said transformer respectively.

7. A combined doorbell and smoke detection device for alerting a homeowner when a guest has arrived and further when a dangerous level of smoke is present within a building structure, said combined doorbell and smoke detection device comprising:

a housing having a plurality of linear and monolithically formed sides, one of said sides including a plurality of openings formed adjacent to top corners of said housing, said one side being directly engaged against a support surface wherein a plurality of fasteners are passed through said openings and into said support surface such that said housing is statically maintained at an elevated position during operating conditions;

a door bell chime nested within said housing;

a first control unit nested within said housing and being electrically coupled directly to said door bell chime;

a carbon monoxide smoke detector nested within said housing and disposed adjacent to said door bell chime;

an ionization smoke detector nested within said housing and seated adjacent to said carbon monoxide smoke detector;

a second control unit electrically coupled to said carbon monoxide and ionization smoke detectors respectively such that each of said carbon monoxide and ionization smoke detectors are independently and simultaneously operable with each other and said door bell chime respectively, said second control unit generating and transmitting an output signal to said carbon monoxide and ionization smoke detectors based upon a predetermined user input signal, wherein said second control unit further comprises an amplifier for increasing an intensity of said output signal during operating conditions, wherein said second control unit is directly and independently coupled to said ionization and carbon monoxide smoke detectors respectively;

a power interrupt diverting switch disposed within said housing and electrically mated to an external power supply source;

an internal power supply source nested within said housing and directly coupled to said power interrupt diverting switch; and a transformer electrically and directly coupled to said power interrupt diverting switch as well as said first and second control units for selectively converting a first voltage level received from the external power supply source to a second voltage level transmitted to said first and second control units respectively;

wherein said power interrupt diverting switch channels power from said internal power supply source to said first and second control units when the external power supply source is inactive.

8. The device of claim 7, wherein said second control unit comprises:

an analog-to-digital converter for receiving said input signal in an analog format and transmitting said output signal to a digital format;

a processor electrically coupled to said analog-to-digital converter;

a memory electrically coupled to said processor and including software instructions that cause said second control unit to independently toggle said carbon monoxide and ionization smoke detectors between active and inactive modes, said software instructions performing the steps of a. determining whether one of said ionization and carbon monoxide smoke detectors has detected one of a maximum smoke and carbon monoxide level in the ambient atmosphere;

b. determining a duration of time in which said one detector has emitted a unique distress signal for more than a predetermined threshold time frame;

c. deactivating another one of said ionization and carbon monoxide smoke detectors until said distress signal is discontinued so that the operator can audibly identify which of said ionization and carbon monoxide smoke detectors has been triggered.

9. The device of claim 7, wherein said power interrupt diverting switch is directly coupled to said first and second controllers as well as said transformer respectively.

* * * * *